US005555856A

United States Patent [19]

Bauer et al.

[11] Patent Number: 5,555,856

[45] Date of Patent: Sep. 17, 1996

[54] OIL-COOLED RECIPROCATING INTERNAL COMBUSTION ENGINE

[75] Inventors: Lothar Bauer, Köln; Herbert Schleiermacher, Brühl; Werner Lemme, Rösrath; Wolfgang Strusch, Köln, all of Germany

[73] Assignee: Klockner-Humboldt-Deutz AG, Cologne, Germany

[21] Appl. No.: 358,082

[22] Filed: Dec. 15, 1994

[30] Foreign Application Priority Data

Dec. 15, 1993 [DE] Germany ..... 43 42 799.5

[51] Int. Cl.[6] ..... F01P 3/00

[52] U.S. Cl. ..... 123/41.42; 123/196 R; 184/6.5

[58] Field of Search ..... 123/41.42, 196 R; 184/1.5, 6.22, 6.5, 104.3

[56] References Cited

PUBLICATIONS

SAE–Paper 891864, The Engineering Society For Advancing Mobility Land Sea Air and Space Sep. 11–14, 1989.

*Primary Examiner*—Noah P. Kamen

*Attorney, Agent, or Firm*—Hardaway Law Firm, PA; Charles L. Schwab

[57] ABSTRACT

An oil-cooled or oil-air-cooled reciprocating internal combustion engine having a cylinder crankcase provided with oil fittings which are manufacturable at a low cost and are accessible for servicing, adjustment and replacement from the exterior of the engine.

8 Claims, 2 Drawing Sheets

OIL-COOLED RECIPROCATING INTERNAL COMBUSTION ENGINE

TECHNICAL FIELD

This invention relates to an oil-cooled or oil-air-cooled reciprocating internal combustion engine having a cylinder crankcase provided with oil fittings.

PRIOR ART STATEMENT

In FIG. 11 of SAE Paper 891864, a reciprocating internal combustion engine is illustrated which has an oil thermostat and connections for oil heating. This construction is relatively expensive because it involves an additional part bolted onto the cylinder crankcase and has corresponding seal surfaces. Furthermore, this additional part is relatively difficult of access because it is located below the cooling air guiding hood of the reciprocating internal combustion engine.

OBJECTS AND SUMMARY OF THE INVENTION

It is an object of the invention to create a reciprocating internal combustion engine whose oil fittings are manufacturable at low fabrication cost and are accessible from outside the engine without supplementary measures and require a minimum amount of sealing surface.

The object is achieved by incorporating the oil fittings into the cylinder crankcase in an integrated manner which eliminates an additional part and its sealing surfaces. By this means, fabrication costs, assembly costs, operating costs, repair costs and storage costs are saved. Furthermore, the possibility of incorrect assembly is eliminated. The accessibility from outside the engine makes possible easy servicing, adjustment and inspection of the oil fittings.

It is advantageous that an oil thermostat, an oil filter base, a pressurizer valve, a heating valve, an anti-draining valve, a heating supply connection and a heating return connection (provided as oil fittings), the pressurizer valve, the heating valve, the anti-draining valve, the heating supply connection and the heating return connection are all positioned to form a valve strip. These oil fittings are functionally related. The oil thermostat controls the oil flow to the oil filter base and oil cooler, the pressurizer valve holds the oil pressure constant in the cooling oil and lubricating oil system of the reciprocating internal combustion engine, and the remaining oil fittings serve as an oil-fed heating. The assembly of the pressurizer valve and the heating fittings into a valve strip minimizes their space requirement. For this reason, it is possible to place them on the flywheel end of the reciprocating internal combustion engine, which makes a considerable amount of space available for the mounting of other attached parts to the side wall of the reciprocating internal combustion engine.

There is also an advantage in positioning the valve strip and the oil filter base outside the cooling air guiding hood. By this means, these parts can be inspected, serviced and maintained without disassembly of the cooling air guiding hood. This not only simplifies the work but also makes it possible to perform work with the motor running, without endangering the reciprocating internal combustion engine by removing the cooling air guiding hood and thus disabling the cooling.

With regard to fabrication cost and space requirement, there is an advantage in having the oil fittings arranged perpendicular to the longitudinal plane of the cylinder crankcase and in positioning the oil fittings of the valve strip and the oil thermostat to lie in a common plane. By this arrangement, a common machining direction for all oil fittings is guaranteed. Furthermore, the relatively narrow valve strip has a small space requirement, so that the side wall of the reciprocating internal combustion engine has sufficient space for further attached parts. This is, in particular, important for a engine having only two cylinders, because in such an engine all required attached parts must be mounted on a relatively narrow side wall of the cylinder crankcase.

It is advantageous that the oil thermostat, the oil filter base, the pressurizer valve, the heating valve, the anti-draining valve, the heating supply connection and the heating return connection are in flow connection via a connecting line cast in the cylinder crankcase. In this arrangement, the oil fittings are in flow connection without machining, whereby machining cost is minimized.

The cast-in connecting line has, in the region of a control rod hole, a place open toward the interior of the cylinder crankcase, which open place is bridged over by means of a transition pipe that is pressed into the connecting line. The core for the connecting line receives ample, and positionally accurate, support at both ends and a simple flow connection is effected from the oil thermostat to the remaining oil fittings.

The connecting line in the plane of an oil pan flange is positioned at an acute angle relative to a side wall of the oil pan. In this position, the bled oil is conveyed tangentially back into the oil pan without the formation of oil foam. In this way, trouble-free lubrication and reliable operation is guaranteed in case the valve lifters having hydraulic compensation or play.

It is further desirable that all oil fittings except the oil filter base are closable by means of threaded plugs that have the same dimensions. Advantages relating to fabrication, assembly and logistics are achieved by this means. This feature is used to advantage in an engine which does not have an oil thermostat and oil heating.

BRIEF DESCRIPTION OF THE DRAWINGS

Further features of the invention follow from the description of the drawings, in which.

DETAILED DESCRIPTION OF THE DRAWINGS

Figure 1:
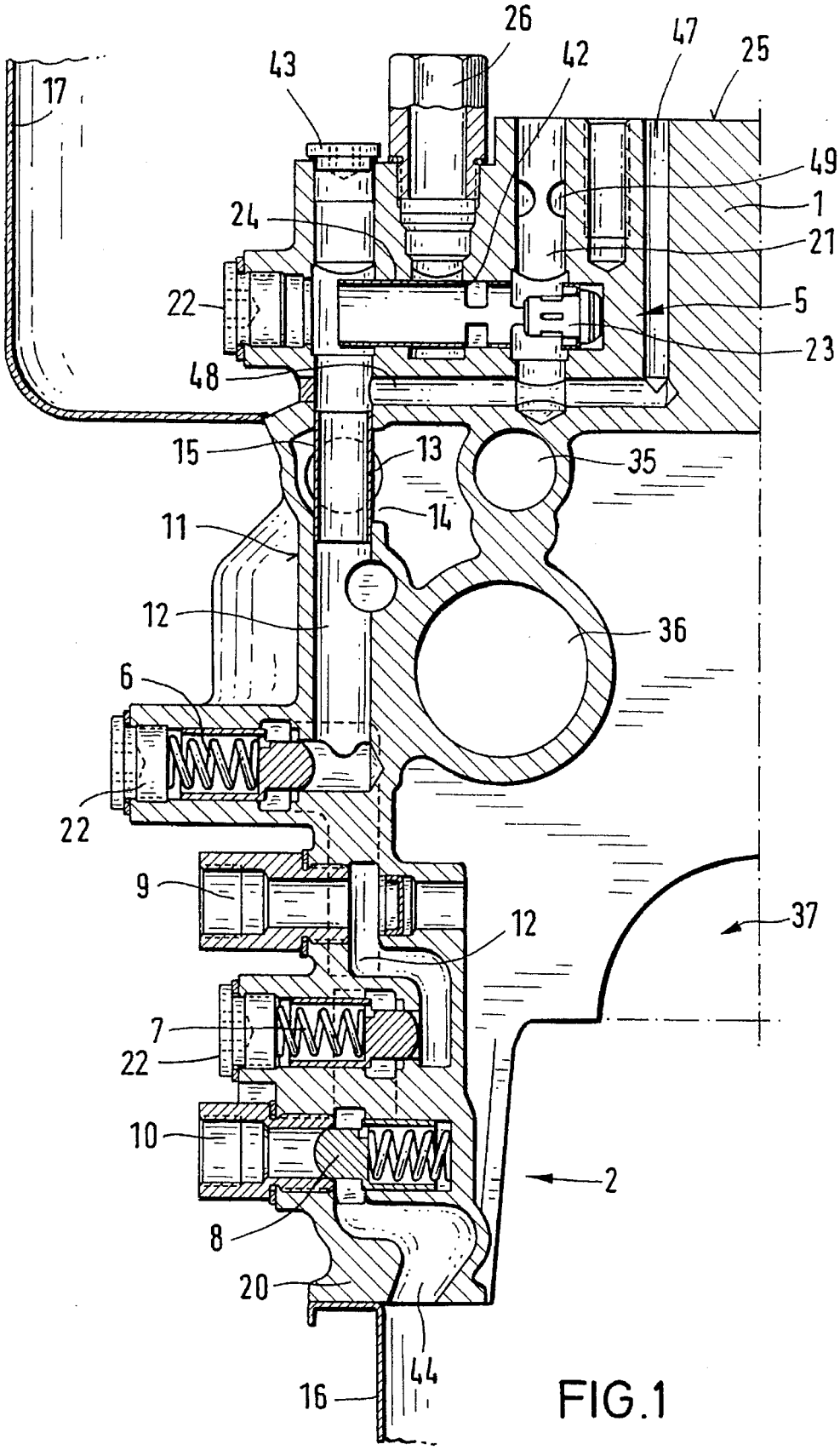
FIG. 1 is a cross section through the valve strip.

FIG. 1 shows, on the end 25 of the cylinder crankcase 1 toward the cylinder head, an oil inlet 21, which is in flow connection with the cylinder cooling spaces, not illustrated, via a throttle hole 49, and a head oil transverse hole, which is in flow connection with a cylinder head, not illustrated, via a head oil return line 47. The oil inlet 21 and the head oil transverse hole lead to an oil thermostat 5. The oil thermostat consists of an expansion body 23 and a piston valve 24 actuated by said expansion body. The piston valve is made as a hollow body with a control port, which has a control edge 42. Depending on the temperature of the oil flowing in via the oil inlet 21, the control edge 42 exposes a more-or-less large cross section to an oil cooler supply 26 and simultaneously throttles the oil drainage via the hollow piston valve 24 into a connecting line 12. The connecting line connects the oil thermostat 5 with an oil filter base 18 and oil fittings of a valve strip 2. The connecting line 12 is cast and opens, in the gasket plane of an oil pan flange 20, into an oil pan 16. In the region of a control rod hole 13, the connecting line 12 is designed open toward the interior of the crankcase. The open place 14 is bridged over by a transition pipe 15, which is pressed into the connecting line 12 machined from the end 25 toward the cylinder head. At the end 25 toward the cylinder head, the connecting line 12 is sealed oil-tight by means of a connecting line plug 43. A similar plug 22 is used for the hole for the piston valve 24.

The connecting line 12 leads further to a pressurizer valve 6. The latter serves to maintain the oil pressure in the oil lubricating and oil cooling system of the internal combustion engine. On the way to the pressurizer valve 6, a part of the connecting line 12 branches off to the oil filter base 18.

After the pressurizer valve 6, the connecting line 12 leads to a heating supply hole 9 and further, past a heating valve 7, to a heating return hole 10 having an anti-draining valve 8, to a line discharge 44, from which the bled oil exits into the oil pan 16. The line discharge 44 is located in the immediate vicinity of the side wall of the oil pan 16 with a tangential orientation to said oil pan.

FIG. 1 further shows a part of a crankshaft bearing 37, a camshaft bearing 36, and an oil supply line 35. From FIG. 1 it can be clearly seen that the valve strip 2 is incorporated in the side wall 11 of the crankcase 1 below and outside of a cooling air guiding hood 17.

Figure 2:
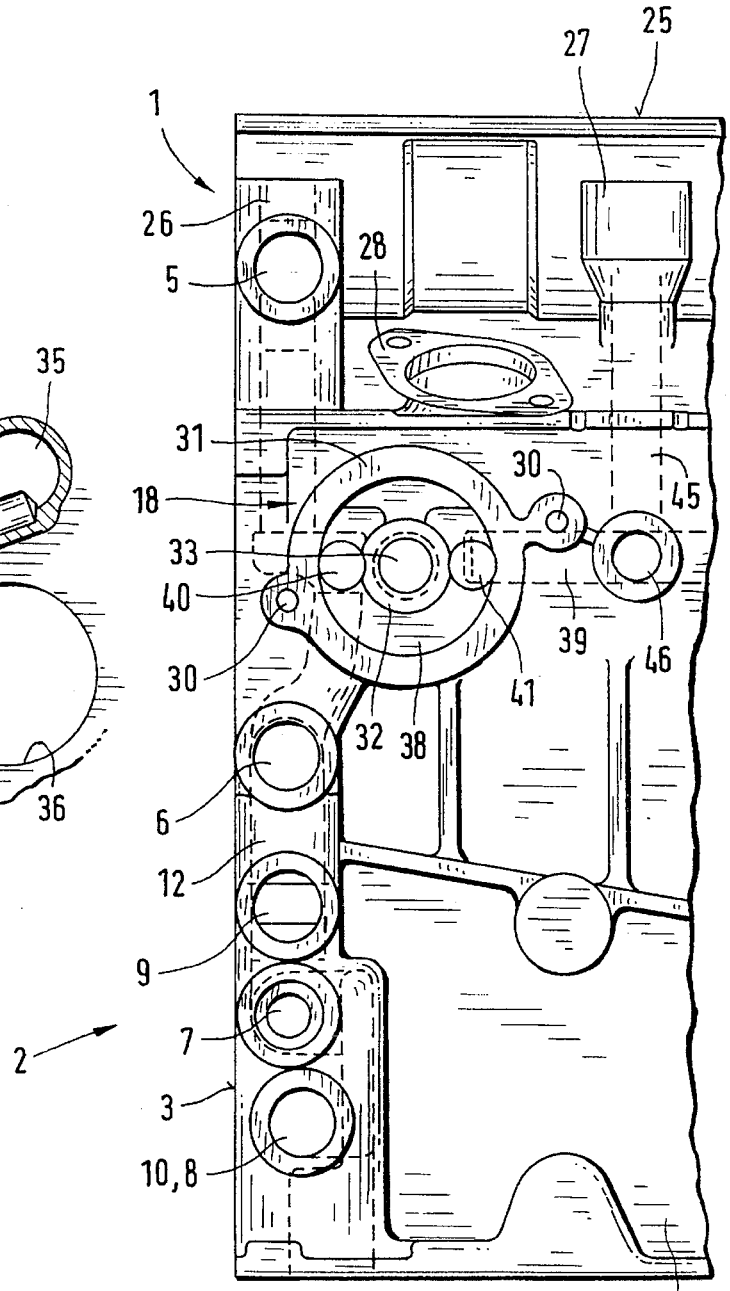
FIG. 2 is a top view of the side wall of the cylinder crankcase with the oil fittings and with oil lines illustrated by dashed lines.

FIG. 2 shows the position of the valve strip 2 on the flywheel end 3 of the cylinder crankcase 1. Furthermore, the oil filter base 18 is illustrated. The latter exhibits an outer circular flange 31 and an inner circular flange 32. An annulus 38 is provided between said flanges, and a central tapped hole 33 is provided in the center of the oil filter base 18. The cast annulus 38 is in flow connection with the cast connecting line 12 via a first oil filter base hole 40 and with an oil return line 39 via a second oil filter base hole 41. The oil return line 39 is in flow connection via a transverse hole 46 with a connecting hole 45, which opens into an oil cooler return 27.

Figure 3:
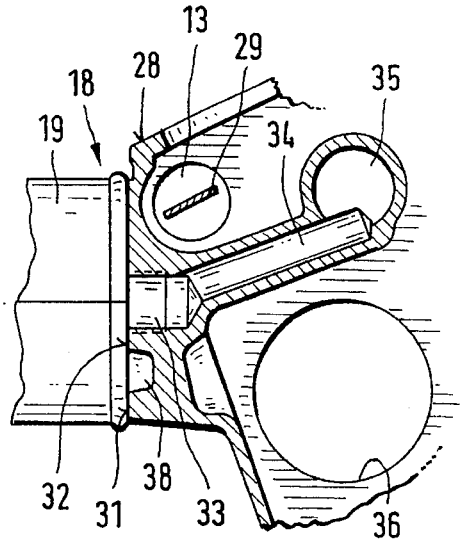
FIG. 3 is a vertical section through the oil filter base.

The oil filter 19, illustrated in FIG. 3, is mounted on the oil filter base 18 with the aid of a hollow screw, which is screwed into the central tapped hole 33. Alternatively, it is possible to mount an oil filter adapter, likewise not illustrated, on the oil filter base 18 with the aid of two tapped holes 30. In this case, the oil filter 19 takes up a perpendicular installed position. For the case of the horizontal installed position of the oil filter 19 directly on the oil filter base 18, the tapped holes 30 can serve for the attachment of an oil catch pan, not illustrated.

FIG. 2 further shows a fuel injection pump flange 28, to which an individual fuel injection pump, not illustrated, is attached.

FIG. 3 shows the oil filter base 18 in section with the oil filter 19 directly screwed thereto. From the central tapped hole 33, a lubricating oil hole 34 leads to the lubricating oil supply hole 35, from which the camshaft bearing 36 and the crankshaft bearing 37 are supplied with lubricating oil. FIG. 3 further shows how the lubricating oil hole 34 is arranged between the control rod hole 13 with the control rod 29 and the camshaft bearing 36.

In a simplified embodiment of the oil-cooled reciprocating internal combustion engine, the thermostat 5 is replaced by a bushing, which is pressed into the guide hole of the piston valve 24 in the region of the connecting hole 12 and seals the latter with respect to the guide hole of the piston valve 24 and preserves only the connection between the oil supply 21 and the oil cooler supply 26. In case of omission of the oil heating, the heating supply connection 9, the heating return connection 10, the heating valve 7 and the anti-draining valve 8 are omitted. In this case, all holes of the valve strip 2 are closed with identical threaded plugs 22.

OPERATION OF THE INVENTION

The oil of the oil-cooled reciprocating internal combustion engine, after flowing through the cooling spaces, not illustrated, passes via the oil supply 21 to the oil thermostat 5. Before the operating temperature of the oil is reached, the piston valve 24 is in the position illustrated in FIG. 1. In this position, the control edge 42 of the piston valve 24 closes off the oil cooler supply 26, by which means the oil does not pass to the oil cooler and thus is not cooled. It passes through the hollow piston valve 24 into the connecting line 12 and, from there, via the first oil filter base hole 40, into the cast annulus 38 of the oil filter base 18. When the operating temperature of the oil is exceeded, the expansion body 23 of the oil thermostat 5 expands and displaces the piston valve 24. By this means, the control edge 42 of the piston valve 24 exposes the oil cooler supply 26, by which means a more-or-less large quantity of oil, depending on the oil temperature, passes into the oil cooler supply 26 and thus into the oil cooler, not illustrated. From said oil cooler, the cooled oil moves via the oil cooler return 27 into the connecting hole 45 and further, via the transverse hole 46, into the cooler return line 39. From there, the cooled oil passes via the second oil filter base hole 41 into the annulus 38. The annulus 38 is in flow connection with the supply of the oil filter 19. After flowing through the oil filter 19, the cleaned oil passes via a hollow screw, not illustrated, into the central tapped hole 33 and further, via the lubricating oil hole 34, into the lubricating oil supply hole 35. From the last, the camshaft bearing 36 and the crankshaft bearing 37, among others, are supplied with cleaned and cooled lubricating oil.

The pressurizer valve 6 in the connecting line 12 serves to maintain the requisite system pressure. Because the quantity of oil delivered by an oil pump, not illustrated, exceeds the quantity required, part of the oil delivered is conveyed via the pressurizer valve by means of the connecting line 12 to the line discharge 44 of said connecting line and from there back into the oil pan 16. The position and discharge direction of the line discharge 44 insure entry of the oil into the oil pan 16 without foaming.

The oil bled from the pressurizer valve 6 is available for heating purposes. A heating heat exchanger, not illustrated, is in flow connection with the heating supply connection 9 and the heating return connection 10 via a heating valve, not illustrated. After the opening of the heating metering valve, the oil flows into the heating heat exchanger. The compulsory movement through the heating heat exchanger is guaranteed by a heating valve 7, which prevents short-circuiting of the heating heat exchanger. Dry running of the entire heating system, which would result in falsification of the oil level in the oil pan, is prevented by means of the anti-draining valve 8.

The construction according to the invention offers the advantage of a low-cost, space-saving arrangement of the oil fittings in the valve strip, which are accessible from outside the engine at all times.

What is claimed is:

1. An oil-cooled reciprocating internal combustion engine comprising:

a cylinder crankcase, said cylinder crankcase being sealingly closed by a cylinder head and an oil pan;

a crankshaft rotatably supported in said cylinder crankcase;

a cylinder liner in said cylinder crankcase;

a piston guided in said cylinder liner, a connecting rod interconnecting said piston and said crankshaft; and oil fittings in said cylinder crankcase (1), said oil fittings being positioned on said crankcase so as to be accessible from outside said engine, said oil fittings including an oil filter base (18), a pressurizer valve (6), a heating valve (7), an anti-draining valve (8), a heating supply connection (9) and a heating return connection (10); said pressurizer valve (6), said heating valve (7), said anti-draining valve (8), said heating supply connection (9) and said heating return connection (10) forming a valve strip (2).

2. The oil-cooled reciprocating internal combustion engine of claim 1 wherein said engine includes a flywheel end (3) and said cylinder crankcase includes a side wall (11) and wherein said oil fittings are in a part of said side wall (11) of said cylinder crankcase (1) disposed at said flywheel end (3) of said cylinder crankcase.

3. The oil-cooled reciprocating internal combustion engine of claim 1 and further comprising a cooling air guiding hood (17) on said engine and an oil filter base (18) on said cylinder crankcase and wherein said valve strip (2) and oil filter base (18) are outside of said cooling air guiding hood (17).

4. The oil-cooled reciprocating internal combustion engine of claim 3 wherein said oil fittings, excluding said oil filter base (18), are closable by identical threaded plugs (22).

5. The oil-cooled reciprocating internal combustion engine of claim 4 wherein said cylinder crankcase includes a cast-in connecting line and wherein said oil thermostat (5), said oil filter base (18), said pressurizer valve (6), said heating valve (7), said anti-draining valve (8), said heating supply connection (9) and said heating return connection (10) are in flow connection via said connecting line (12) cast in said cylinder crankcase (1).

6. The oil-cooled reciprocating internal combustion engine of claim 5 wherein said cylinder crankcase includes a control rod hole (13) and wherein said cast-in connecting line (12) has, in the region of said control rod hole (13), an open place (14) opening toward the interior of said cylinder crankcase (1), and further comprising a transition pipe (15) pressed into said connecting line (12), said transition pipe (15) bridging said open place (14).

7. The oil-cooled reciprocating internal combustion engine of claim 1 and further comprising an oil thermostat on said cylinder crankcase and wherein said oil fittings are disposed perpendicular to the longitudinal plane of the cylinder crankcase (1) and said oil fittings of said valve strip (2) and said oil thermostat (5) lie in a common plane.

8. The oil-cooled reciprocating internal combustion engine of claim 7 wherein said cylinder crankcase includes an oil pan flange (20) and further comprising an oil pan (16) having a side wall (11), said connecting line (12) in the plane of said oil pan flange (20) being disposed at an acute angle relative to said side wall of said oil pan (16).

* * * * *